US012435453B1

(12) United States Patent
Waltz

(10) Patent No.: US 12,435,453 B1
(45) Date of Patent: Oct. 7, 2025

(54) CROCHET TOOL

(71) Applicant: Kendall Waltz, Fort Wayne, IN (US)

(72) Inventor: Kendall Waltz, Fort Wayne, IN (US)

( * ) Notice: Subject to any disclaimer, the term of this patent is extended or adjusted under 35 U.S.C. 154(b) by 0 days.

(21) Appl. No.: 18/629,448

(22) Filed: Apr. 8, 2024

(51) Int. Cl.
*D04B 33/00* (2006.01)
*D04B 31/00* (2006.01)

(52) U.S. Cl.
CPC ..... *D04B 33/00* (2013.01); *D04B 31/00* (2013.01)

(58) Field of Classification Search
CPC ..... D04B 33/00; D04B 3/00; D04B 5/00
USPC ..... 66/1 A
See application file for complete search history.

(56) References Cited

U.S. PATENT DOCUMENTS 297,881 A * 4/1884 Vetter ..... D04B 3/00 66/1 A
762,493 A * 6/1904 Ruddy ..... D04B 33/00 28/149
1,078,242 A * 11/1913 Bartholomew ..... D04B 33/00 D15/66
1,691,527 A * 11/1928 Sakurai ..... D04B 17/00 28/149
1,975,924 A * 10/1934 Collingbourne ..... D03D 29/00 28/151
2,112,768 A * 3/1938 Fox ..... D04B 33/00 D15/78
2,582,319 A * 1/1952 Ellis, Jr. ..... D04B 3/00 235/124
3,054,277 A * 9/1962 Broschard ..... D04B 3/00 242/157 R
3,234,759 A * 2/1966 Larrasoain ..... D04B 9/54 66/1 A
3,739,437 A * 6/1973 Alberici ..... D03D 29/00 28/151
3,827,091 A * 8/1974 Hocevar ..... D04D 5/00 28/149
4,072,173 A * 2/1978 Markowitz ..... D03D 29/00 28/151
4,109,355 A * 8/1978 Davitian ..... D03D 29/00 28/151
2007/0214842 A1* 9/2007 Lozar ..... D04D 5/00 66/1 A

* cited by examiner

*Primary Examiner* — Danny Worrell
(74) *Attorney, Agent, or Firm* — Cynthia S. Lamon; Lamon Patent Services

(57) ABSTRACT

A crochet tool for creating a first loop, comprising a card base enabled to be hand-held including a top edge, bottom edge and opposing side edges. The card may include a first cutout positioned at the top edge extending towards an interior of the card, left of a center point of the top edge, a second cutout positioned at the top edge extending towards the interior of the card, a third cutout positioned at the bottom edge of the card opposite the first cutout and a forth cutout positioned at the bottom edge opposite the second cutout and extending towards the interior of the card. The cutouts are used to hold yarn portions of a single string of yarn, thereby enabling a user to create an initial crochet loop.

11 Claims, 6 Drawing Sheets

CROCHET TOOL

BACKGROUND OF THE INVENTION

1. Field of the Invention

The present invention is in the field of a tool or appliance to form an initial crochet loop to begin a creation of a fabric-based article.

2. Description of Related Art

In crocheting, it is common to form loops. An initial loop must be made in a specific manner in order to launch the creation of an article formed from a crochet fabric form. Unfortunately, the loop formation process can be difficult and time consuming to achieve because it is difficult to hold yarn with one hand at several separate points, while grabbing and looping the yarn with a crochet hook held in another hand. While a number of approaches have been tried over the years for forming loops, none has proved entirely acceptable.

As such, there remains a need for crochet tool enabling stationary positioning of yarn in several positions while forming an initial loop and starting a crochet article.

BRIEF SUMMARY OF THE INVENTION

A crochet tool for creating a first loop is provided comprising a card base enabled to be hand-held including a top edge, bottom edge and opposing side edges. In this embodiment, a first cutout may be positioned at the top edge extending towards an interior of the card, left of a center point of the top edge. A second cutout may be positioned at the top edge extending towards the interior of the card, right of the center point of the top edge. A third cutout may also be positioned at the bottom edge of the card opposite the first cutout and extending towards the interior of the card. Additionally, a fourth cutout may be positioned at the bottom edge opposite the second cutout and extending towards the interior of the card. A user may then grasp the card with one hand and use the cutouts to hold yarn segments of a single string of yarn, thereby enabling a user to create an initial crochet loop.

In different embodiments, the cutouts form a triangular apex or a semicircle. In both of these embodiments, the third cutout includes a slot formed by parallel straight edges forming an angle towards a center of the card and the slot has an inner dimension enabling a portion of yarn to be held securely. In this or another embodiment, a rectangular cutout is positioned in an upper center of the card enabling grasping of the yarn segments through the card by a user.

In another embodiment a method of forming an initial loop enabling creation of a crochet article comprises the steps of fitting an end portion of a single strand of yarn in a slot having a width enabled to secure the yarn, the slot extending from a first cutout positioned at a bottom left edge of a rectangular card crochet tool, extending a first segment of the yarn from the slot across a front face of the card to a second cutout positioned at an upper right edge of the card. Further extending a second segment of the yarn from the second cutout straight down a back face of the card to a third cutout positioned at the bottom edge on a right side and then extending a third segment of the yarn across the front face of the card from the third cutout to a fourth cutout positioned at the upper edge at a left side.

With the yarn segments held in place by the cutouts of the card, implementing a hook of a crochet tool to pull a portion of the third segment under the first segment forming a subloop around the crochet tool from the third segment and hooking an upper portion of the third segment again with the crochet tool and pulling it through the subloop thereby forming the initial loop. In one embodiment a rectangular cutout is positioned in an upper center of the card enabling grasping of the yarn segments through the card by a user. In another embodiment, the first through fourth cutouts each form a triangular apex or a semicircle extending away from the upper and lower edges towards an interior of the card and the first cutout includes the slot formed by parallel straight edges forming an angle pointing towards a center of the card.

DETAILED DESCRIPTION OF THE INVENTION

Figure 1B:
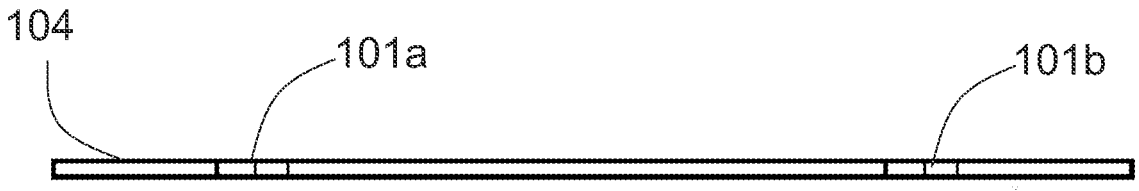
FIG. 1B is an elevated view of a top edge of the crochet tool of FIG. 1A.
Figure 1A:
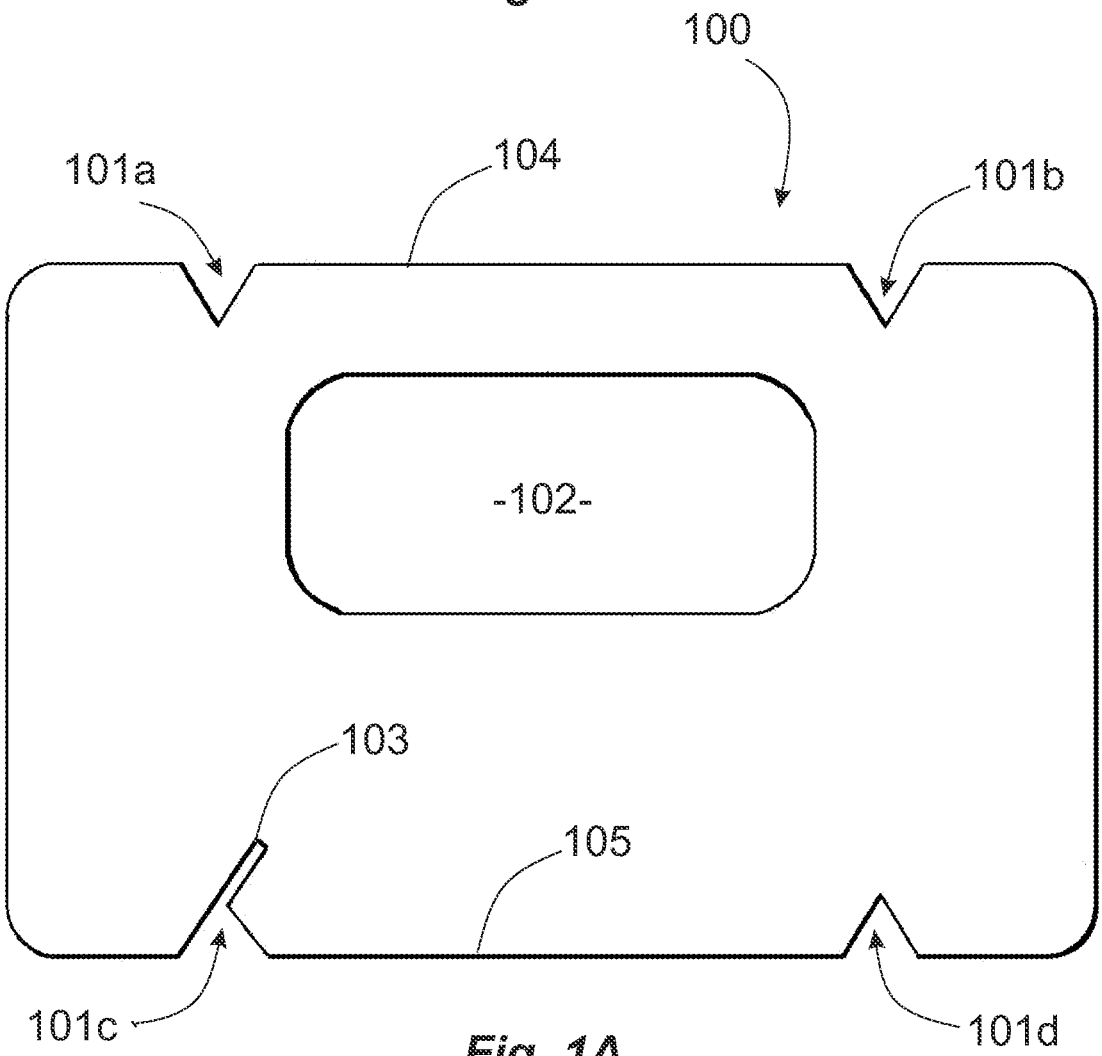
FIG. 1A is an elevated view of a front face of a crochet card in one embodiment.

FIG. 1A shows a front face of a crochet tool in the form of a card 100. Card 100 is a rectangular shape with curved corners that is oriented horizontally when being used. A rectangular cutout 102 may be centered in an upper half of card 100. Cutout 102 is also a rectangular shape with curved corners. Card 100 includes a top edge 104 shown in FIG. 1B. Top edge 104 includes two yarn-retaining cutouts 101*a* and 101*b* that are equidistant to each other. Card 100 includes a bottom edge 105 that also includes two equidistantly spaced cutouts 101*c* and 101*d*. FIG. 1B demonstrates a thickness of card 100 that is consistent throughout the card. Card 100 may be manufactured from any form of plastic or polycarbonate. Additionally, card 100 may be made from wood, glass or a form of metal in another embodiment. A thickness of card 100 may be increased depending upon the material selected for manufacture.

Each of cutouts 101*a*-101*d* may be formed as a two-sided triangular apex forming approximately a 45° angle with the apex high point extending towards the center of the card away from edges 104 and 105. The cutouts 101*a*-101*d* having this shape are enabled to retain one or more strings of yarn while creating an initial loop. Cutout 101*c* is formed off center to a left side of a center point of bottom edge 105. Cutout 101*c* includes a slot 103 having a first and second parallel edges having a dimension between them of less than a dimension of cutout 101*c* measured along bottom edge 105. One of the parallel lines formed by extending a left edge of the apex of 101*c* and the other parallel edge beginning at a top portion of the apex angled to enable the second edge to be parallel with the first edge wherein the width is enabled to snugly hold a single strand of yarn. In this manner, a string end of yarn is held securely in slot 103 as it is a starting point of creating a starting loop explained more fully below.

Figure 2A:
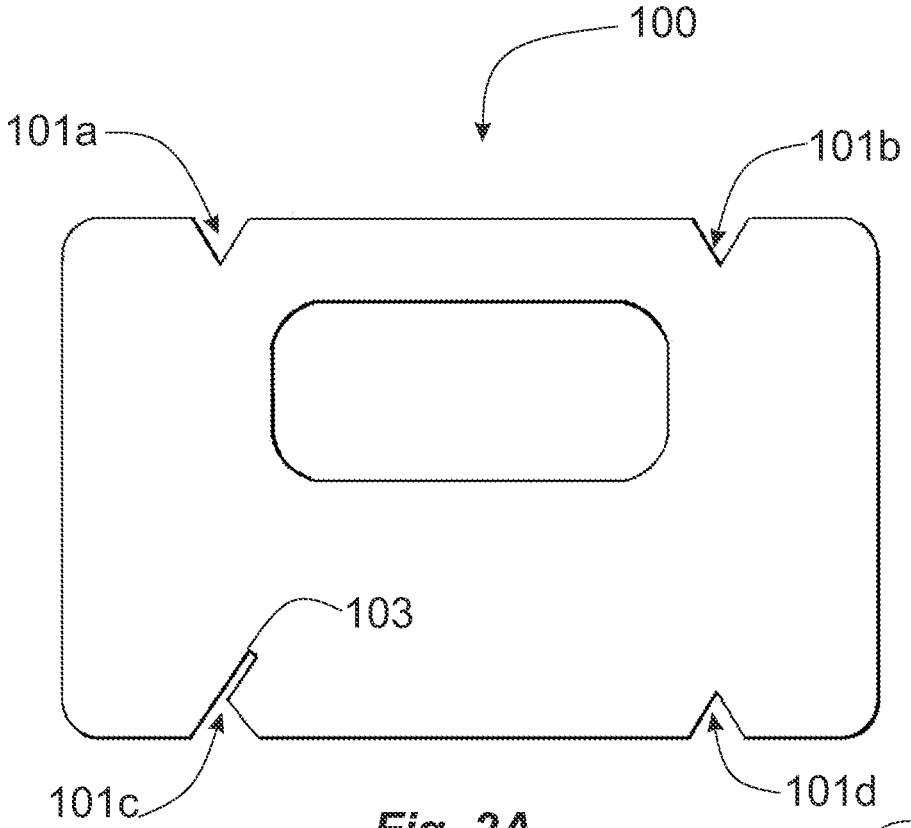
FIG. 2A presents the crochet card of FIG. 1A.
Figure 2B:
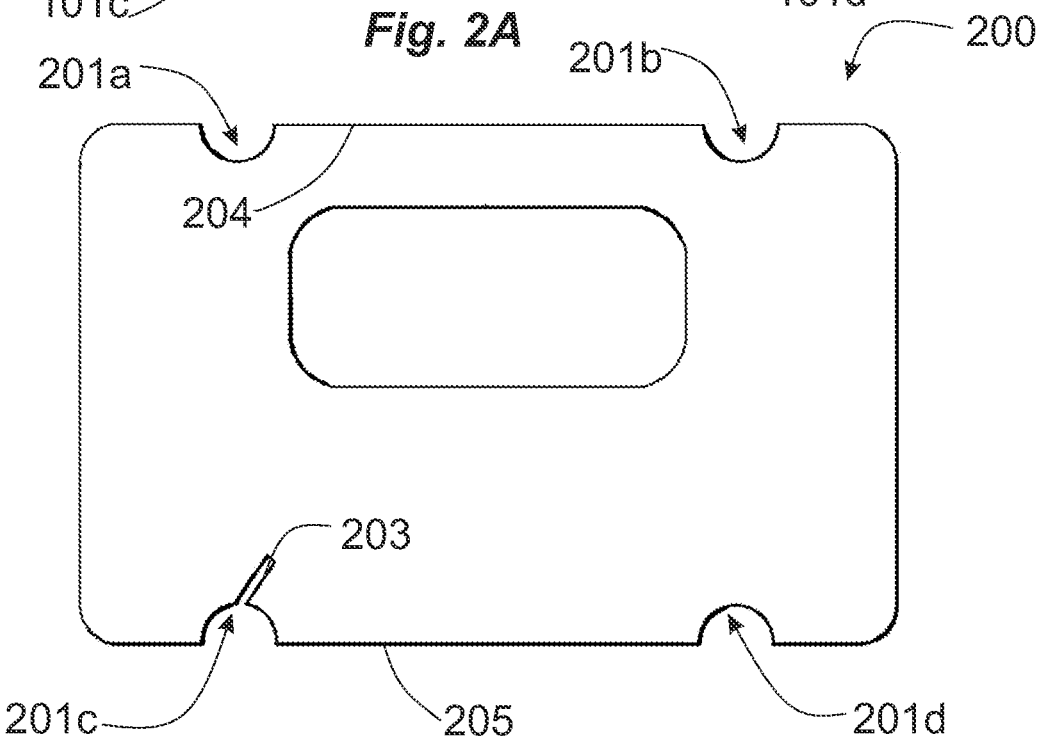
FIG. 2B demonstrates another embodiment of a crochet card with cutouts.
Figure 3:
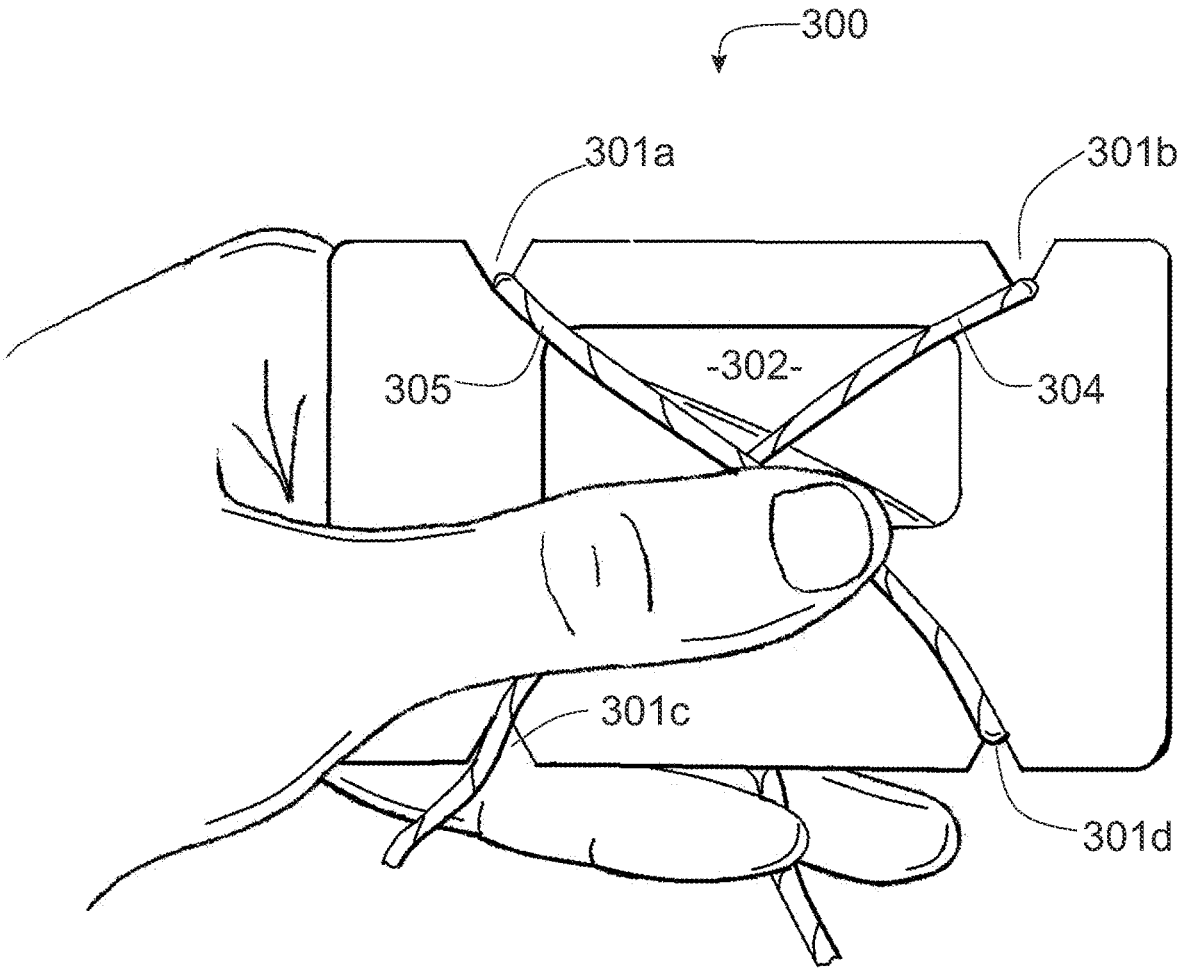
FIG. 3 is an elevated front face view of the crochet card in use in one embodiment.

FIGS. 2A and 2B demonstrate a comparison between different shapes of cutouts. FIG. 2A includes the same cutout shapes in the embodiment of FIG. 1A elements 101*a*-101*d*. FIG. 2B shows an embodiment wherein the cutouts are semicircles. In this embodiment, cutouts 201*c* and 201*d* open towards bottom edge 205, with cutouts 201*a* and 201*b* opening to top edge 204. Cutout 201*c* serves a same purpose as cutout 101*c* which is the starting point of the process of forming a loop. A slot 203 is formed at a top center portion of the semicircle of 201*c* extending at an angle towards a center point of card 200. Slot 203 also includes two parallel edges extending from the semicircle at a similar overall angle similar to that of 103.

FIGS. 3-6 show the step-by-step process of creating a starting crochet loop for creating an article. The process begins at cutout 301*c* of FIG. 3 wherein the card 300 is held by a left hand in this embodiment. For left-handed users, the card need only be turned around so the cutout with the additional slot would be right of center near the lower right corner of the card. The yarn end is held in the slot of 301*c* (not shown). The yarn is then wound from 301*c* across the front of the card across the cutout 301(*b*) forming yard portion 304. The yarn then goes straight down from 301(*b*) on the back side of the card to 301(*d*) (not shown) where the yarn is crossed to 301*a* on the front of the card forming yard portion 305, where 305 lays on top of 304 within cutout 302. In this manner the yarn forms an "x" within the cutout 302. A benefit of having the yarn cross within the cutout is that it may be gripped and held by the left hand.

Figure 4:
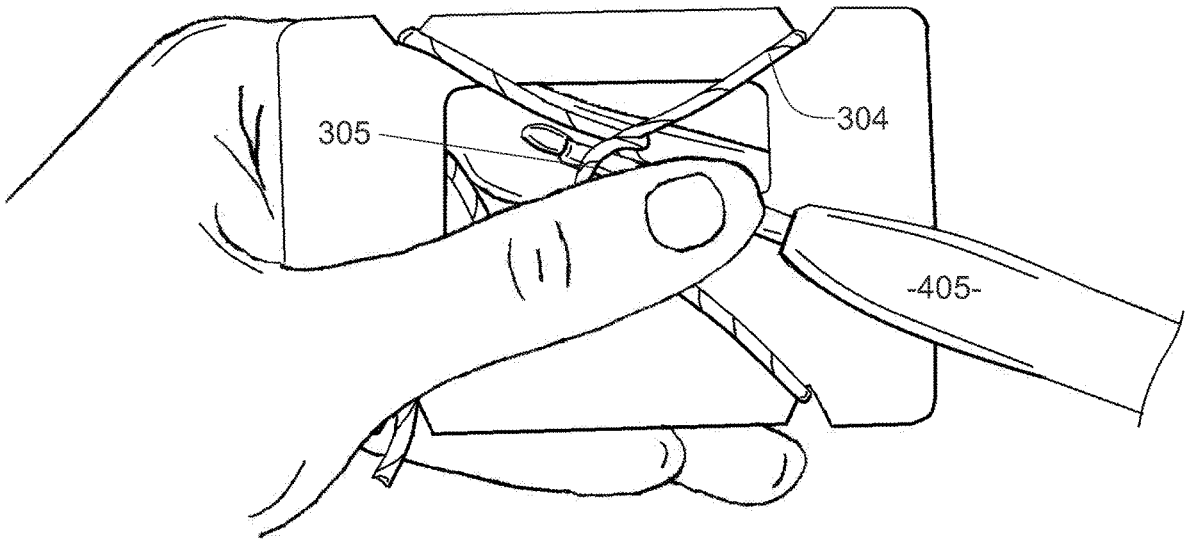
FIG. 4 is an elevated view showing a process of using the crochet card to form an initial loop.
Figure 5:
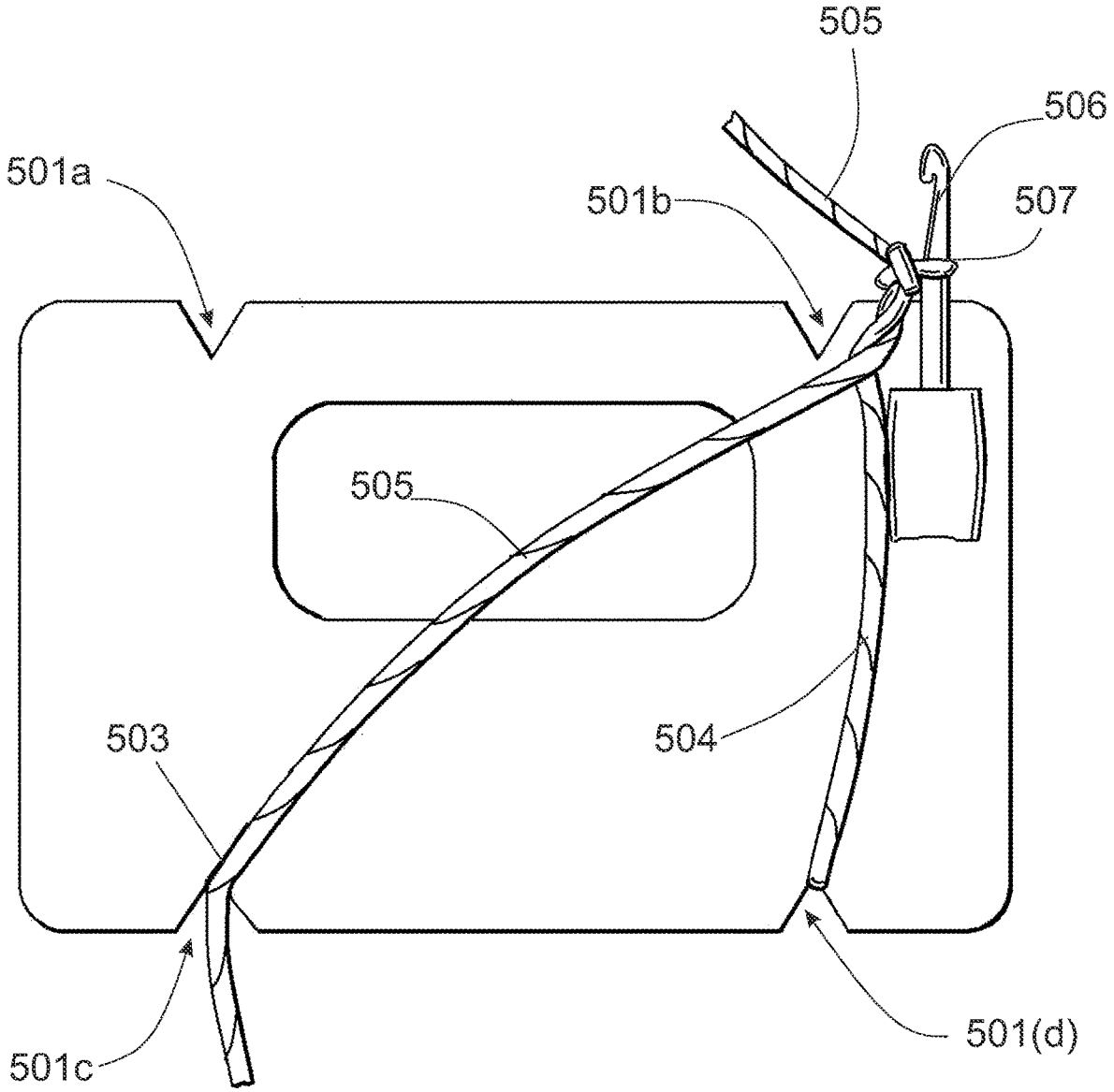
FIG. 5 is an elevated view of a front face of the crochet card after a process forming the initial loop on the card.
Figure 6:
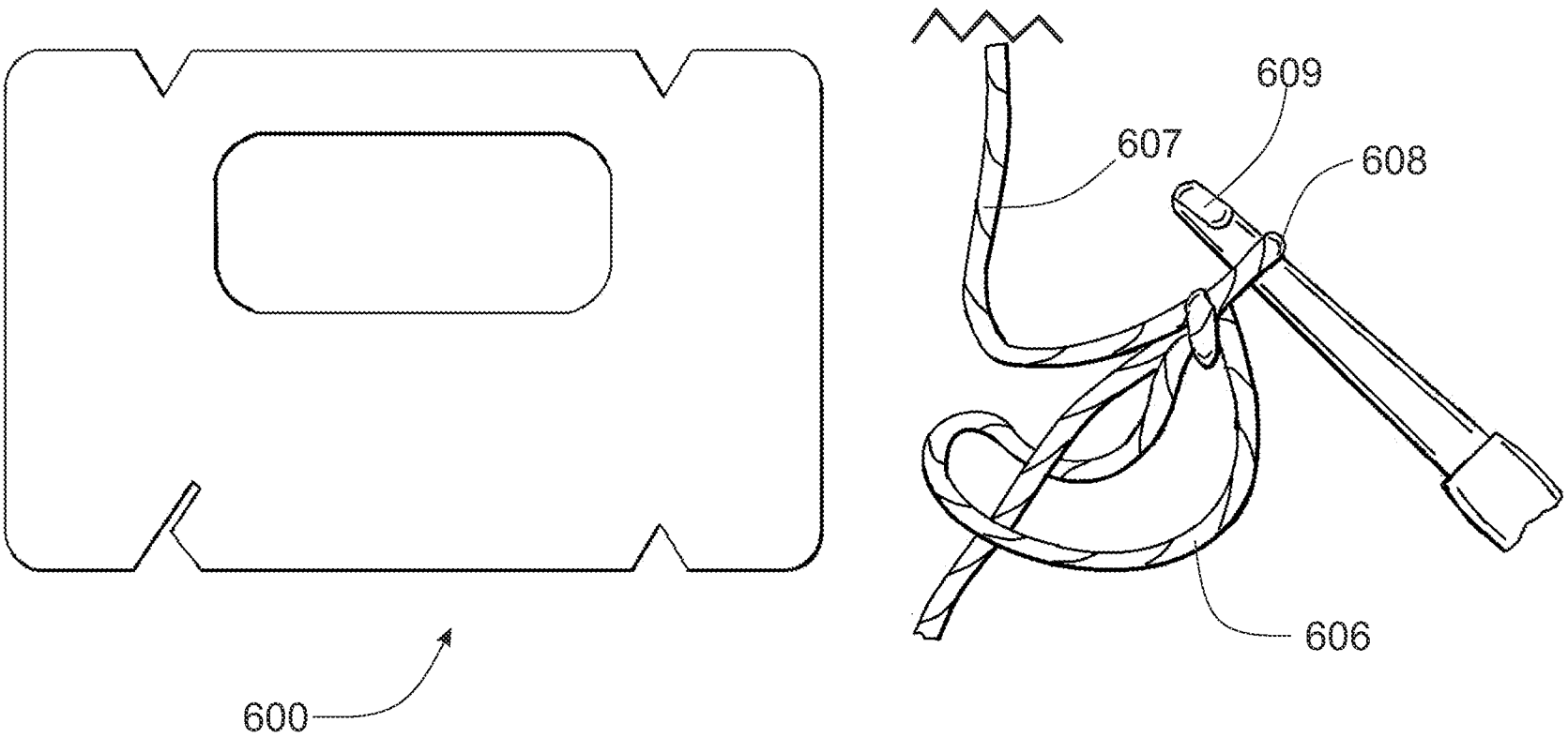
FIG. 6 is a view of a finished initial loop formed by the crochet card.

Next, FIG. 4 shows a crochet hook 405 grabbing yarn portion 305 and pulling it under yarn portion 304 and then grabs yarn portion 305, again, and pulls it under itself as seen in FIG. 5. At this point, the yarn is removed from cutout 501*a* and 501*b* and a loop 606 is formed as shown in FIG. 6. From this point there are two options. One option is to leave the loop on the card, as seen in FIG. 5 with the loop on the card between cutouts 501*b* and 501*d*. In this embodiment, the crochet hook may grab yarn portion 505 above the knot area and pull it through loop 507 around the crochet hook 506 and repeat that move forming a first row of the crochet article.

A second option is to grab loop 606 with a left hand and string 607, with the right hand use crochet hook 609 to grab yarn portion 607 and pull it through loop 608 on the hook and repeat that process forming the first row of a crochet article. The card may be larger or smaller than that shown, for example the card may be between 4 inches by 2.5 inches, 6 inches by 3 inches, etc. The important aspect of size is maintaining the cutout positions and the cutout with the slot being in the left lower corner for a right-handed user and the upper edge cutouts on a given card being positioned opposite lower edge cutouts. Relational sizes, types of crochet hooks and yarn are not intended to be limited by the teachings of this specification. One embodiment of the invention is defined in the following claims.

The invention claimed is:

1. A crochet tool for creating a first loop, comprising;

a card base enabled to be hand-held including a top edge, bottom edge, opposing side edges and opposing planar surfaces;

a rectangular cutout in a center region of the card base, the cutout comprising less than half of an entire surface area of the card base;

a first cutout positioned at the top edge extending towards an interior of the card, left of a center point of the top edge;

a second cutout positioned at the top edge extending towards the interior of the card, right of the center point of the top edge;

a third cutout positioned at the bottom edge of the card opposite the first cutout and extending towards the interior of the card; and a fourth cutout positioned at the bottom edge opposite the second cutout and extending towards the interior of the card;

wherein the rectangular cutout enables fingers of a users hand to enter the rectangular cutout from the opposing planar surfaces to hold segments of a single string of yarn in place and one or more of the first through fourth cutouts are used to hold yarn segments of the single string of yarn, thereby enabling a user to create an initial crochet loop.

2. The crochet tool of claim 1, wherein each of the first through fourth cutouts form a triangular apex.

3. The crochet tool of claim 1 wherein each of the first through fourth cutouts form a semicircle.

4. The crochet tool of claim 1, wherein the third cutout includes a slot formed by parallel straight edges forming an angle towards the rectangular cutout of the card.

5. The crochet tool of claim 4, wherein the slot in the third cutout has an inner dimension enabling a portion of yard to be held securely.

6. The crochet tool of claim 1, wherein a rectangular cutout is positioned in an upper center of the card.

7. A method of forming an initial loop enabling creation of a crochet article comprising the steps of:

a) fitting an end portion of a single strand of yarn in a slot having a width enabled to secure the yarn, the slot extending from a first cutout positioned at a bottom left edge of a rectangular card crochet tool;

b) extending a first segment of the yarn from the slot across a front face of the card to a second cutout positioned at an upper right edge of the card;

c) further extending a second segment of the yarn from the second cutout straight down a back face of the card to a third cutout positioned at the bottom edge on a right side;

d) extending a third segment of the yarn across the front face of the card from the third cutout to a fourth cutout positioned at the upper edge at a left side;

e) implementing a hook of a crochet tool to pull a portion of the third segment under the first segment forming a subloop around the crochet tool from the third segment; and f) hooking an upper portion of the third segment again with the crochet tool and pulling it through the subloop thereby forming the initial loop.

8. The method of claim 7, wherein step f) is repeated forming a first row of loops of an article.

9. The method of claim 7, wherein a rectangular cutout is positioned in an upper center of the card enabling grasping of the yarn segments through the card by a user.

10. The method of claim 7, wherein the first through fourth cutouts each form a triangular apex or a semicircle extending away from the upper and lower edges towards an interior of the card.

11. The crochet tool of claim 7, wherein the first cutout includes the slot formed by parallel straight edges forming an angle pointing towards a center of the card.

* * * * *